US006029631A

United States Patent [19]

Jiewertz et al.

[11] Patent Number: 6,029,631

[45] Date of Patent: Feb. 29, 2000

[54] METHOD OF IDENTIFYING THE COMBUSTION CHAMBER OF A COMBUSTION ENGINE THAT IS IN THE COMPRESSION STROKE, AND A METHOD AND DEVICE FOR STARTING A COMBUSTION ENGINE

[75] Inventors: Sten Jiewertz, Järna; Jan Eckerborn, Bodenheim, both of Sweden

[73] Assignee: Saab Automobile AB, Sweden

[21] Appl. No.: 09/066,487

[22] PCT Filed: Oct. 23, 1996

[86] PCT No.: PCT/SE96/01357

§ 371 Date: Jul. 20, 1998

§ 102(e) Date: Jul. 20, 1998

[87] PCT Pub. No.: WO97/15758

PCT Pub. Date: May 1, 1997

[30] Foreign Application Priority Data

Oct. 24, 1995 [SE] Sweden ..... 9503722-2

[51] Int. Cl.[7] ..... F02P 17/00; F02D 41/34

[52] U.S. Cl. ..... 123/491; 73/116; 123/644; 324/391

[58] Field of Search ..... 123/179.1, 179.16, 123/406.58, 491, 643, 644; 73/116, 117.2, 117.3; 324/379, 380, 391, 399, 392

[56] References Cited

U.S. PATENT DOCUMENTS 5,065,729 11/1991 Krauter et al. ..... 123/643
5,107,817 4/1992 Dittmann et al. ..... 123/643
5,174,267 12/1992 DeBiasi ..... 123/643
5,196,844 3/1993 Tomisawa et al. ..... 701/101 X

FOREIGN PATENT DOCUMENTS 0177145 4/1986 European Pat. Off. .
0619428 10/1994 European Pat. Off. .
3041498 6/1982 Germany .
3041498 9/1982 Germany .
442345 12/1985 Sweden .
2264565 2/1993 United Kingdom .
9221876 12/1992 WIPO .

*Primary Examiner*—Tony M. Argenbright
*Attorney, Agent, or Firm*—Ostrolenk, Faber, Gerb & Soffen LLP

[57] ABSTRACT

A combustion engine comprises at least two combustion chambers and an ignition system having a spark device (11, 13) forming an electrode gap and a charging member (20) for accumulating the electrical energy necessary for generating a spark in the electrode gap. The combustion chambers are in the compression stroke according to a predetermined sequence. During a first engine revolution, high voltage pulses are supplied at a high frequency to all spark devices (11, 13). The spark voltage in the electrode gap of each spark device (11, 13) is measured for each spark. Based on the measured spark voltage of the different spark devices, the combustion chamber that first will be in the compression stroke is determined by means of an electronic control unit (3). Based on the predetermined sequence and the knowledge of the combustion chamber that first is in the compression stroke, fuel is injected in the combustion chamber that next will be in the compression stroke.

17 Claims, 8 Drawing Sheets

METHOD OF IDENTIFYING THE COMBUSTION CHAMBER OF A COMBUSTION ENGINE THAT IS IN THE COMPRESSION STROKE, AND A METHOD AND DEVICE FOR STARTING A COMBUSTION ENGINE

BACKGROUND OF THE INVENTION

The present invention refers to a method of identifying the combustion chamber of a combustion engine that is in the compression stroke. Furthermore, the invention refers to a method and device starting a combustion engine.

In combustion engines having modern electronic ignition systems without high voltage distributors and without camshaft sensors, the proper ignition sequence and the proper injection sequence may not be determined until the engine has been started. After the start as the engine operates, the correct ignition sequence may be determined by means of measuring the ionization current in the cylinder in which the combustion has occurred. According to this prior art, which is described in SE-B-442 345 for instance, a measuring voltage is applied to the ignition circuit in a ground connection between the secondary winding of an ignition coil and a measuring capacitor, which voltage results in a ionization current in the cylinder, and this ionization current is detected in the ground connection by means of a measuring device.

It is known that there is a relationship between the pressure in the combustion chamber of a combustion engine and the spark voltage in the electrode gap of the spark plug. The higher the pressure the higher the spark voltage, which means that the spark voltage is higher when the combustion chamber is in the compression stroke than when it is in the exhaust stroke. Furthermore, since it takes a certain time to build up the voltage resulting in a spark, the spark will occur later, in relation to when the ignition was initiated, when the compression chamber is in a compression stroke than when it is in the exhaust stroke.

The ignition system disclosed in EP-A-0 619 428 refers to an inductive ignition system having two spark plugs connected to a respective end of the secondary winding of an ignition coil. Consequently, the ignition coil will be discharged in such a manner that a voltage having reversed polarity simultaneously is built up across the electrode gap of both the spark plugs. By detecting the spark in both spark plugs and calculating the time difference between the sparks the operating angle of the engine may be determined.

US-A-5 065 729 discloses an inductive electronic ignition system for a combustion engine, which system comprises an ignition coil having a primary winding and two secondary windings each being connected in series to a spark plug forming an electrode gap. The primary winding is connected in series to a transistor controlled by a control unit. Consequently, a spark will be initiated simultaneously in both spark plugs. In order to sense the voltage when the spark occurs, a detector is provided in series with one of the secondary windings and its spark plug, i.e. at the high voltage side. Since the spark voltage increases with increasing compression, it is possible to determine the cylinder that is in the compression stroke and, by means of this knowledge, to control for example the fuel injection during the operation of the engine.

EP-A-0 177 145 discloses a similar ignition system having a device for determining the cylinder that is in the compression stroke in order to synchronize the fuel injection. The device comprises a detector capacitively connected to the high voltage side for determining the spark voltage.

In order to be able to measure the voltage necessary for generating a spark in the electrode gap of a spark plug, a high voltage probe, connected to a measuring instrument disclosing the voltage, for example an oscilloscope, is normally required. The high voltage probe is connected to the high voltage side of the ignition system between the ignition coil and the spark plug. The voltage to be measured depends on the level of the voltage supplied by the ignition system. In a capacitive ignition system the voltage may be as high as 35–40 kV. By measuring such high voltages problems due to flash-over between the measuring equipment and surrounding metal parts of the engine frequently arises.

WO-A-9 221 876 discloses a diagnostic device for detecting electrical defects of a capacitive ignition system of a combustion engine. The ignition system comprises a charging capacitor and a coil having a primary winding and a secondary winding being connected in series to a spark plug forming an electrode gap. The diagnostic device is adapted to estimate the time delay between the ignition signal and the ignition, and this estimate is made by measuring the time period from the triggering, i.e. from initiating the discharge of the charging capacitor, to the moment that the current through the primary winding has achieved a predetermined threshold value. At this threshold value it is assumed that a spark occurs in the electrode gap.

Consequently, WO-A-9 221 876 does not teach how to determine exactly the time period between the triggering and the spark. The time delay estimated is compared to a number of threshold values in order to determine the condition of the ignition system.

DE-A-3 041 498 discloses a conventional ignition system having a measuring and regulating device for determining the time delay between the triggering and the spark, i.e. from an ignition control signal flank initiating the ignition to the occurrence of a spark. The spark is detected by sensing the negative going edge of the voltage at the measuring and regulating device. The determined time delay is utilized to adjust the ignition point of time.

SUMMARY OF THE INVENTION

The object of the present invention is to provide an improved way of, during the first revolution of the starting process determining the combustion chamber that is in the compression stroke and that should be ignited and determining the combustion chamber that should be supplied with fuel for the next suction stroke. More specifically, the present invention aims at providing a method and a device, which enables starting a combustion engine during the first revolution of the starting process.

Since the spark voltage of the spark devices increases with the increasing compression it is possible to determine very quickly the combustion chamber that is in the compression stroke by supplying, during a first engine revolution, all the spark devices sequentially with high voltage pulses with high frequency and by measuring the spark voltage by each spark. In particular, this may be done already during the first half engine revolution, as the actual combustion chamber rotates from the lower dead centre to the upper dead centre.

According to a preferred embodiment the compression chambers are in the compression stroke in a determined succession and based on this succession and the knowledge of the combustion chamber that first is in the compression stroke, fuel is injected in the compression chamber that next is in the compression stroke.

Consequently, the present invention enables a very rapid starting of a combustion engine, which means that no unburnt fuel need to pass through the engine and thus result in high emissions.

An embodiment of the present invention utilizes the fact that there is a certain time delay from the initiating of the discharge to the moment when a sufficient voltage has been built up across the electrode gap of the spark device to result in a spark. By measuring this time period from the initiating of the ignition to the transient pulse occurs, which indicates a spark, the size of the spark voltage may easily be calculated since the voltage across the electrode gap is linearly proportional to the time, at least during the time period preceding the spark. The transient pulse is sharp enough to be detected in a very easy manner, i.e. no advanced measuring equipment is necessary. Preferably, the ignition system comprises a high voltage side and a low voltage side, said pulse being sensed at the low voltage side. Thereby, no connection has to be made to the high voltage side.

According to an embodiment, the present invention may be applied to a capacitive ignition system in which the electrical energy necessary for generating a spark is accumulated in a charging capacitor. Since the ignition voltage in such an ignition system is significantly higher than in a conventional inductive ignition system, a connection to the high voltage side would be even more problematic. The present invention may be applied to all frequently used ignition systems and without any difficulties be connected to existing combustion engines.

BRIEF DESCRIPTION OF THE DRAWINGS

The present invention will now be explained more closely with reference to the embodiments disclosed in the drawings.

DESCRIPTION OF DIFFERENT EMBODIMENTS

Figure 1:
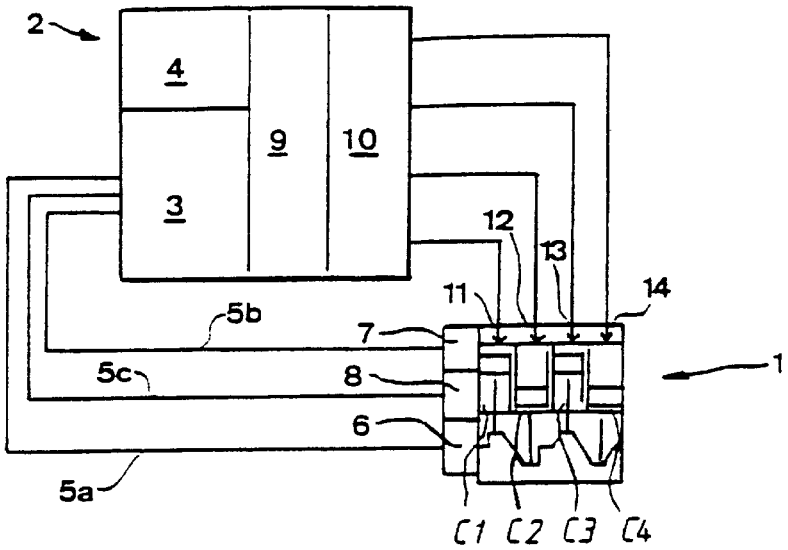
FIG. 1 shows a block diagram of a combustion engine.

FIG. 1 shows a combustion engine 1 of a four-stroke type and having four combustion chambers, in the following referred to as the cylinders C1, C2, C3, C4, and an ignition system 2 controlled by a control unit 3 having a microcomputer. The ignition system further comprises a control unit 3 and a charging circuit 4. The control unit 3 is via the wires 5*a*, 5*b*, 5*c* connected to a crankshaft sensor 6 provided on the engine 1, a sensor 7 for sensing the suction pressure, and a sensor 8 for sensing the engine temperature. There may be further sensors, which have not been described in this description. The ignition system 2 is in the example disclosed of a capacitive kind and, furthermore, comprises discharge circuits 9 and ignition circuits 10 for the spark devices in the form of spark plugs 11–14 of respective cylinders C1, C2, C3, C4. It is clear from the figure how a signal is carried from the crankshaft sensor 6 via the wire 5*a* to the ignition system 2. In the control unit 3 a microcomputer calculates the point of time for the ignition in respective cylinders C1, C2, C3, C4 based on input data from the crankshaft sensor 6, the inlet pressure sensor 7, the engine temperature sensor 8 and further possible sensors. When the piston of one of the cylinders C1 in the cylinder pair C1, C3 is in the compression stroke of the four-stroke cycle, the piston of the other cylinder C3 thus is in the exhaust stroke. However, the pistons of one of the cylinder pairs C1, C3 rotate with a difference of 180° relative to the pistons of the other cylinder pair C2, C4, which means that when the pistons of one of the cylinder pairs C1, C3 are in the upper dead center, the pistons of the other cylinder pair C2, C4 are in the lower dead center. Thus, the cylinders C1, C2, C3, C4 are in a compression stroke in an ignition succession constructively determined.

Figure 2:
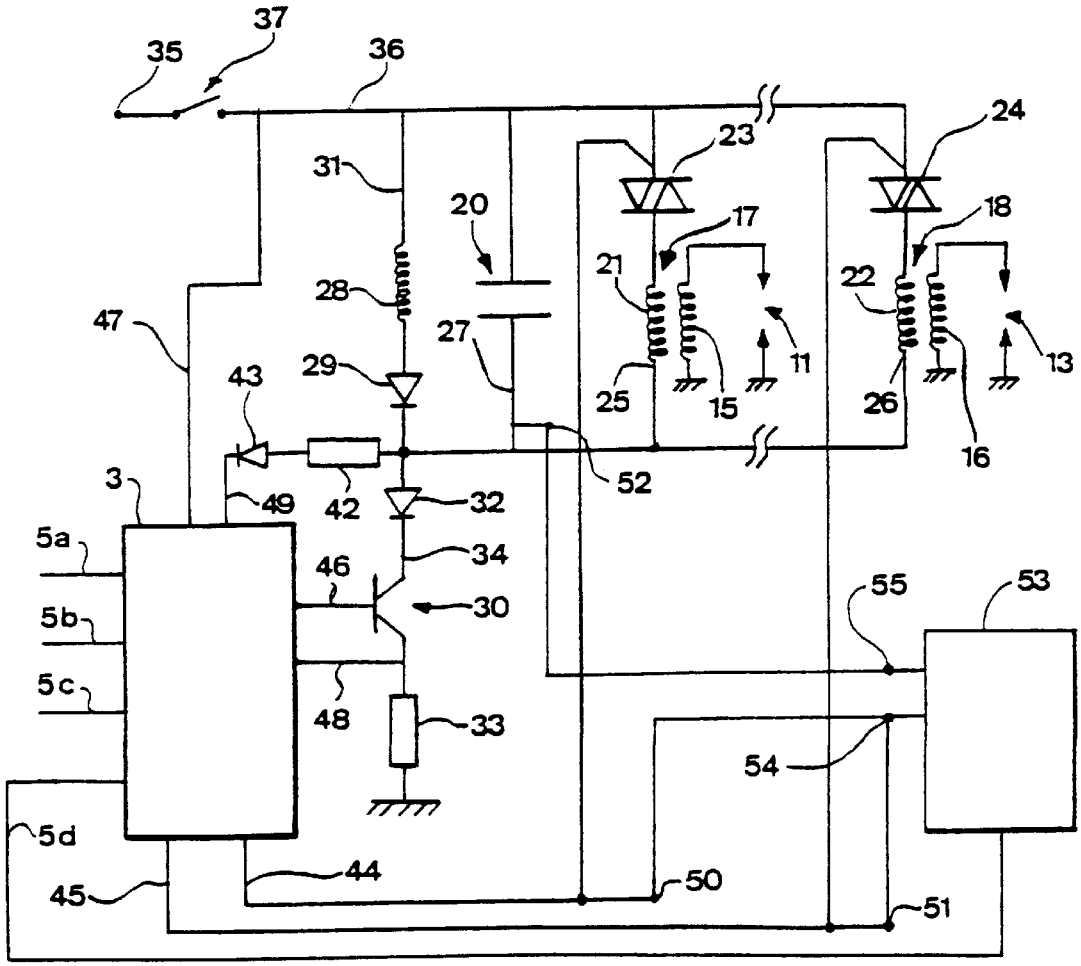
FIG. 2 shows a principal wiring diagram of an ignition system.

In FIG. 2 merely the spark plugs 11, 13 of the spark plugs 11–14 in FIG. 1 are disclosed. The spark plugs 11 and 13 are each connected to a respective secondary winding 15, 16 of a corresponding number of ignition coils 17, 18. The primary windings 21, 22 of the ignition coils 17, 18 are each connected in series to respective current break members 23, 24, which in the example disclosed are triacs. Each primary winding 21, 22 and triac 23, 24 form a discharge circuit 25, 26 being connected in parallel to an ignition capacitor 20 of a wire 27. A coil 28 is also connected in parallel to the ignition capacitor 20. The coil 28 is connected in series to a diode 29 of a wire 31. The wire 27 having the ignition capacitor 20 and all wires 25, 26, 31 connected in parallel thereto are on one hand connected to a second current break member 30, for example a transistor, which is connected in series to another diode 32, and a resistance 33 of a wire 34, and on the other hand to a direct current source 35, preferably a 12V battery, via a wire 36 comprising an ignition switch key 37. The diodes 29, 32 are oriented such that when the transistor 30 is open for current passage, current may be supplied from the battery 35 through the wires 31, 32 to ground.

The triacs 23, 24 and the transistor 30 are controlled by signals through the wires 44, 45 and 46, respectively, from the control unit 3. Besides the input signals disclosed in FIG. 1 via the wires 5*a*, 5*b*, 5*c*, an input signal regarding the voltage level of the battery 35 is supplied via a wire 47 to the control unit 3. A wire 48 connects the control unit 3 to the wire 34 between the transistor 30 and the resistance 33 and transfers a potential corresponding to the charging current to the control unit 3. Via a wire 49 having a resistance 42 and a diode 43 the control unit 3 also receives a signal responsive to the potential of the ignition capacitor 20.

The ignition system according to FIG. 2 functions principally as follows. When starting the engine the switch 37 closes the wire 36 and the battery 35 supplies direct current to ground via the charging circuit 31, 34 comprising the coil 28, the diodes 29, 32, the transistor 30, and the resistance 33. Thus, the control unit 3 keeps the triacs 23, 24 off, whereas the transistor 30 is on for current passage. When the charging current and a potential corresponding thereto of the wire 48 have achieved a predetermined level, the control unit 3 breaks the current through the transistor 30. Thereby, energy charged in the coil 28 is transferred to the charging capacitor 20 which then is charged to a voltage of about 400V. Thereafter, when the control unit 3 in response to the input signals of the wires 5, 41 provides an output signal to for example the triac 23 at the ignition point of time determined in the control unit 3, the triac 23 turns on and the charging capacitor 20 is discharged through the primary winding 21. Thereby, an ignition voltage is generated in the secondary coil 15, which results in the forming of the ignition spark in the electrode gap of the spark plug 11. The potential of the charging capacitor 20 is sensed by the control unit 3 via the wire 49 and when this potential has fallen under a predetermined value the control unit starts a new charging cycle by supplying an output signal via the wire 46 to the transistor 30 for turning on the transistor. simultaneously, the triac 23 has again turned off blocking current through the wire 25. Thereafter, the control unit 3 in the same manner as described above once again provides for the charging and discharging of the charging capacitor 20.

At the output 50, 51 the triggering signal from the control unit 3 may be sensed, i.e. the signal opening the triac 23, 24 and thus initiating the discharge of the charging capacitor 20, and at the output 52 the voltage level of the charging capacitor 20 may be sensed.

Figure 3:
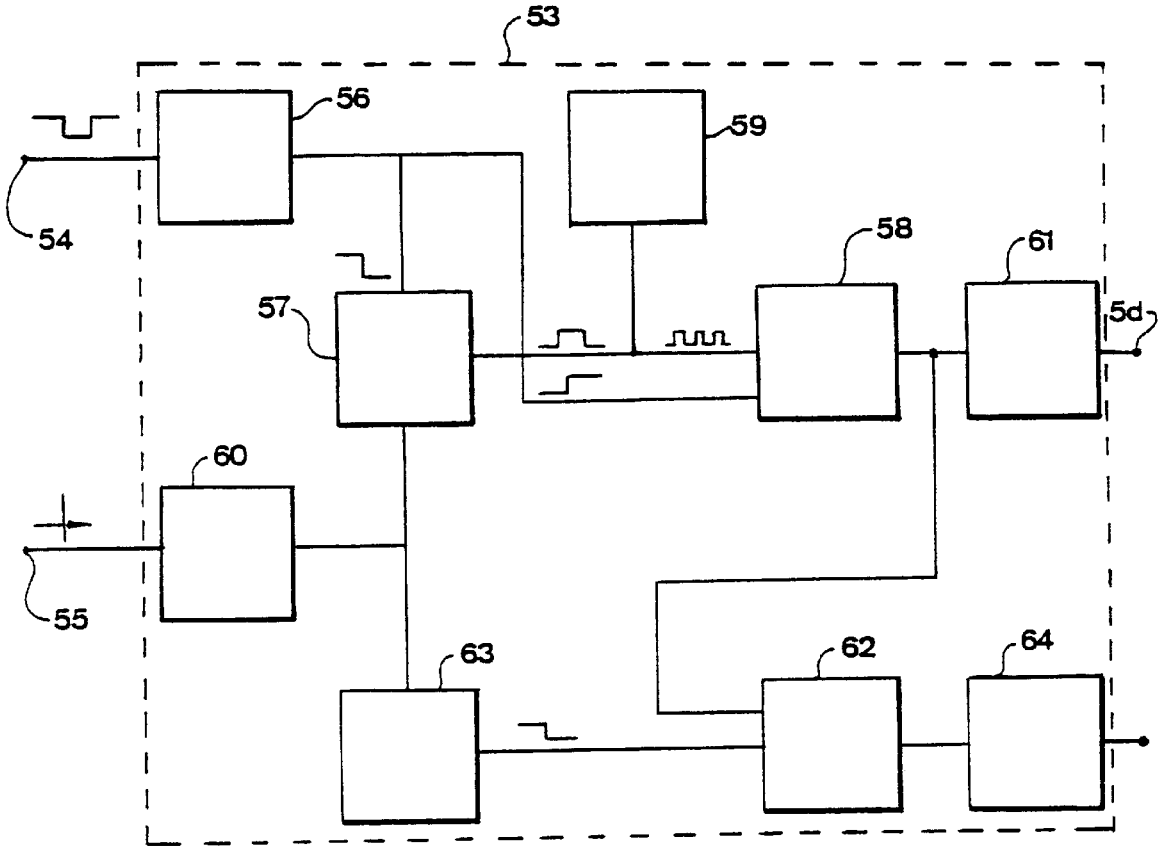
FIG. 3 shows a block diagram illustrating the measurement of the spark voltage.

FIG. 2 discloses a circuit 53 for determining the level of the spark voltage. The circuit 53, which will be described more closely with reference to FIG. 3, comprises an input 54 to be connected to the output 50, 51 and an input 55 to be connected to the output 52. In series with the input 54 a signal adapting unit 56 is provided. From there the adapted signal is transferred to a D-flip-flop 57 and to a binary counter 58 in order to zero the counter. From the D-flip-flop 57 a pulse is transferred via an oscillator 59 to the counter 58 in order to start the counter. In series with the input 55 a further signal adapting unit 60 is provided from which a pulse is transferred via the D-flip-flop 57 to the counter 58 in order to stop the counter. Consequently, a time value is obtained by the counter 58, from which value the level of the spark voltage may be calculated by means of a processing unit 61. The digital value from the counter 58 may be converted to an analogue value by means of a D/A-converter 62, which is activated by a triggering unit 63 when a value should be read. By means of a further processing unit 64, an analogue value of the spark voltage thereafter may be read. The value of the spark voltage calculated by the processing unit 61 is returned via the wire 5*d* to the control unit 3 to be utilized for controlling the starting process and the fuel injection in a manner to be described in the following.

Figure 4:
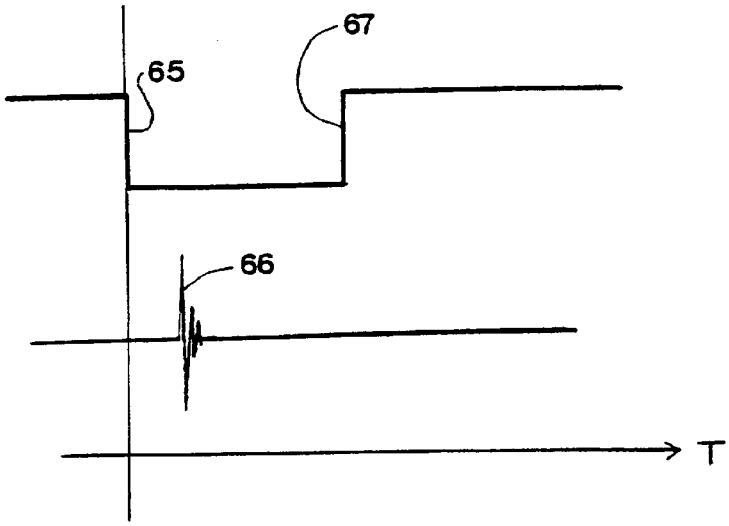
FIG. 4 shows a diagram illustrating a triggering pulse and a transient pulse.

In the example disclosed, the triacs 23, 24 are arranged in such a manner that they are off for current passage when a voltage is applied to the wire 44, 45. When this voltage ceases, i.e. at the negative going edge 65 of the voltage, see FIG. 4, the ignition system is triggered and the triac 23, 24 are turned on, thereby starting the discharge of the charging capacitors 20, and via the output 50, 51 and the circuit 53 starting the counter 58. When the spark occurs and the transient pulse 66 appears, the latter is registered via the output 52 by the circuit 53 stopping the counter 58. When the voltage again is applied to the wire 44, 45, i.e. at the positive going edge 67 of the voltage, this is detected via the output 50, 51 by the circuit 53 zeroing the counter 58. It should be noted that the current break members 23, 24 also may be arranged to turn off in response to a positive pulse and close in response to a negative pulse.

Figure 5:
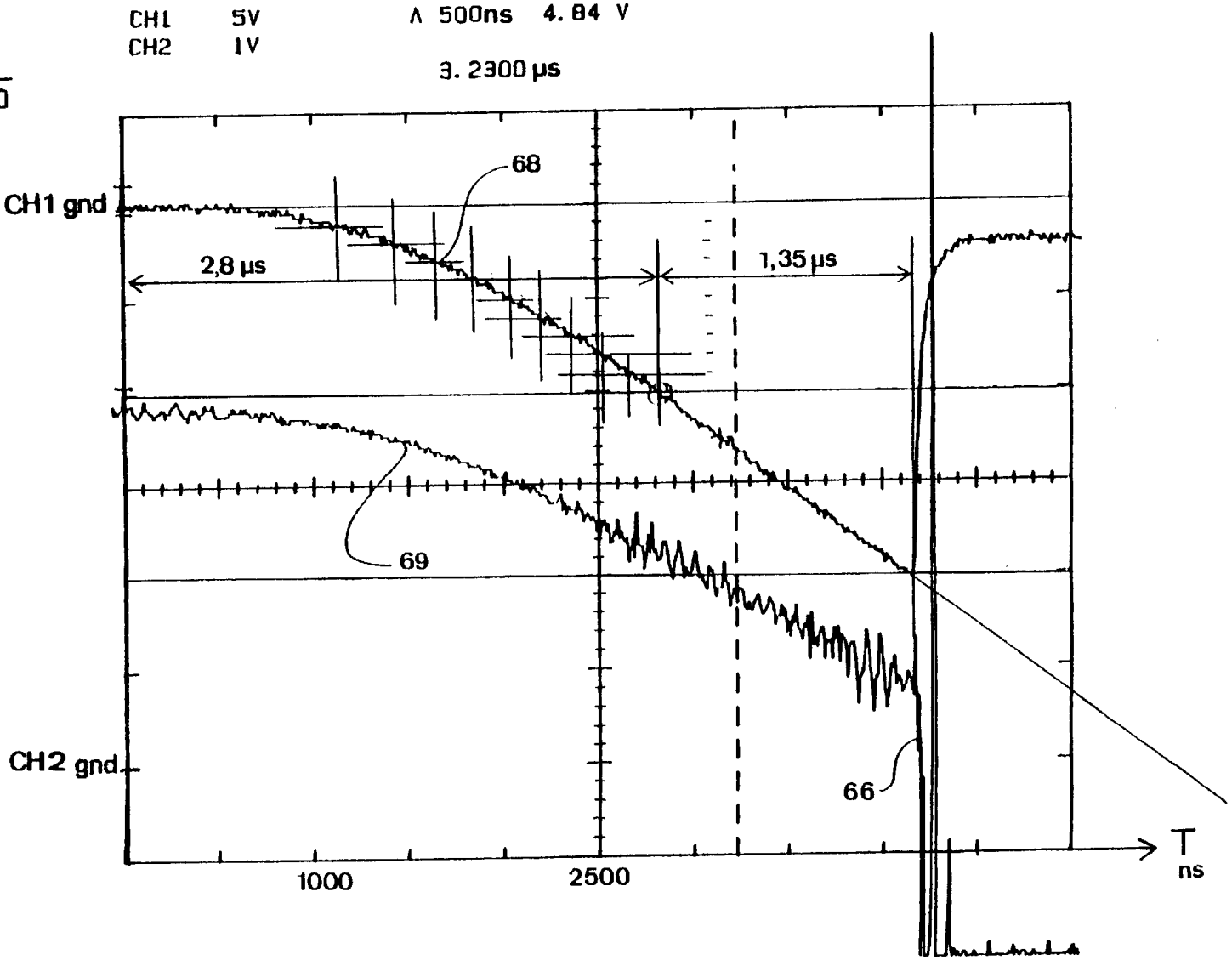
FIGS. 5–9 show the measuring result of measurements of the spark voltage.
Figure 6:
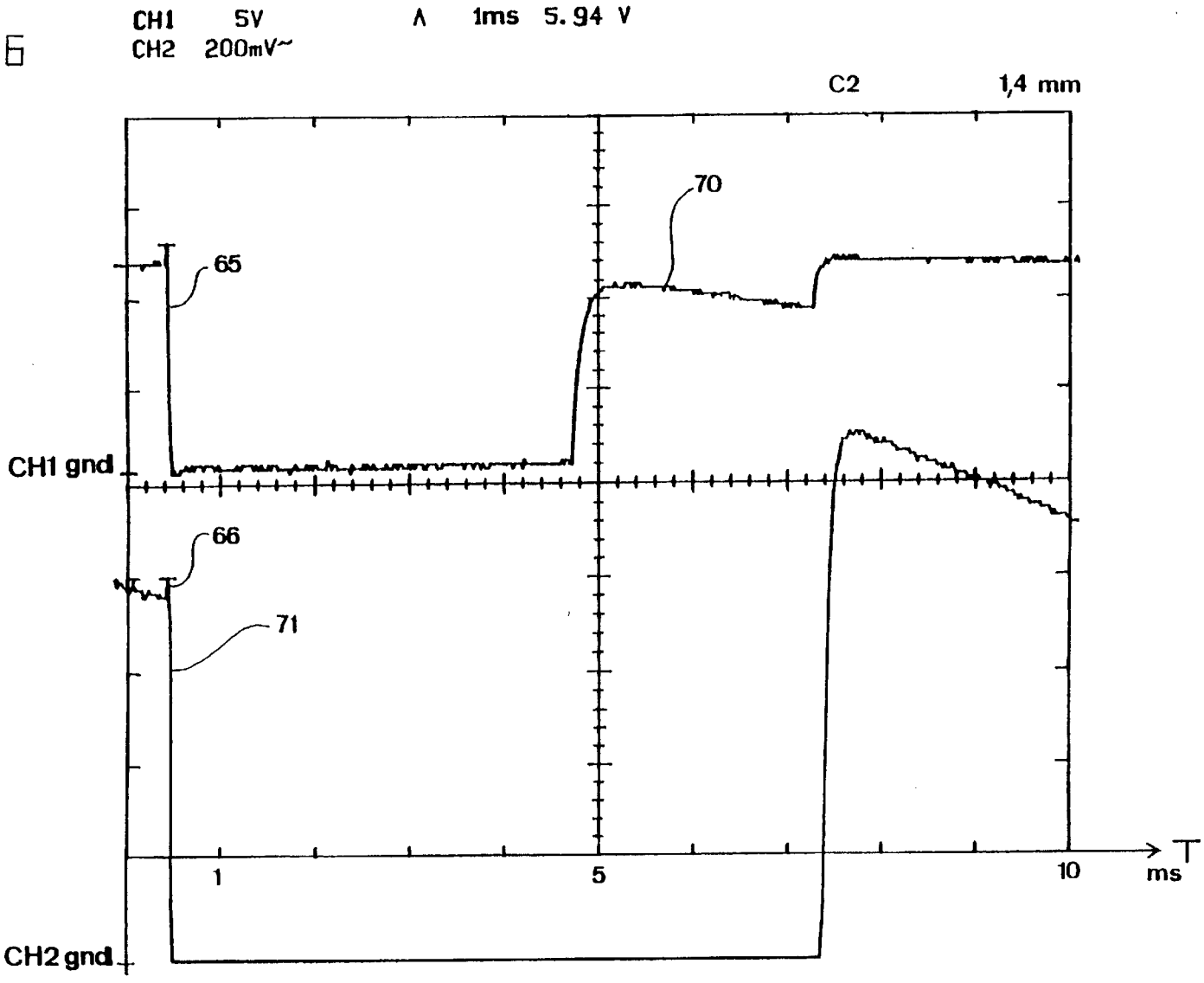
Figure 7:
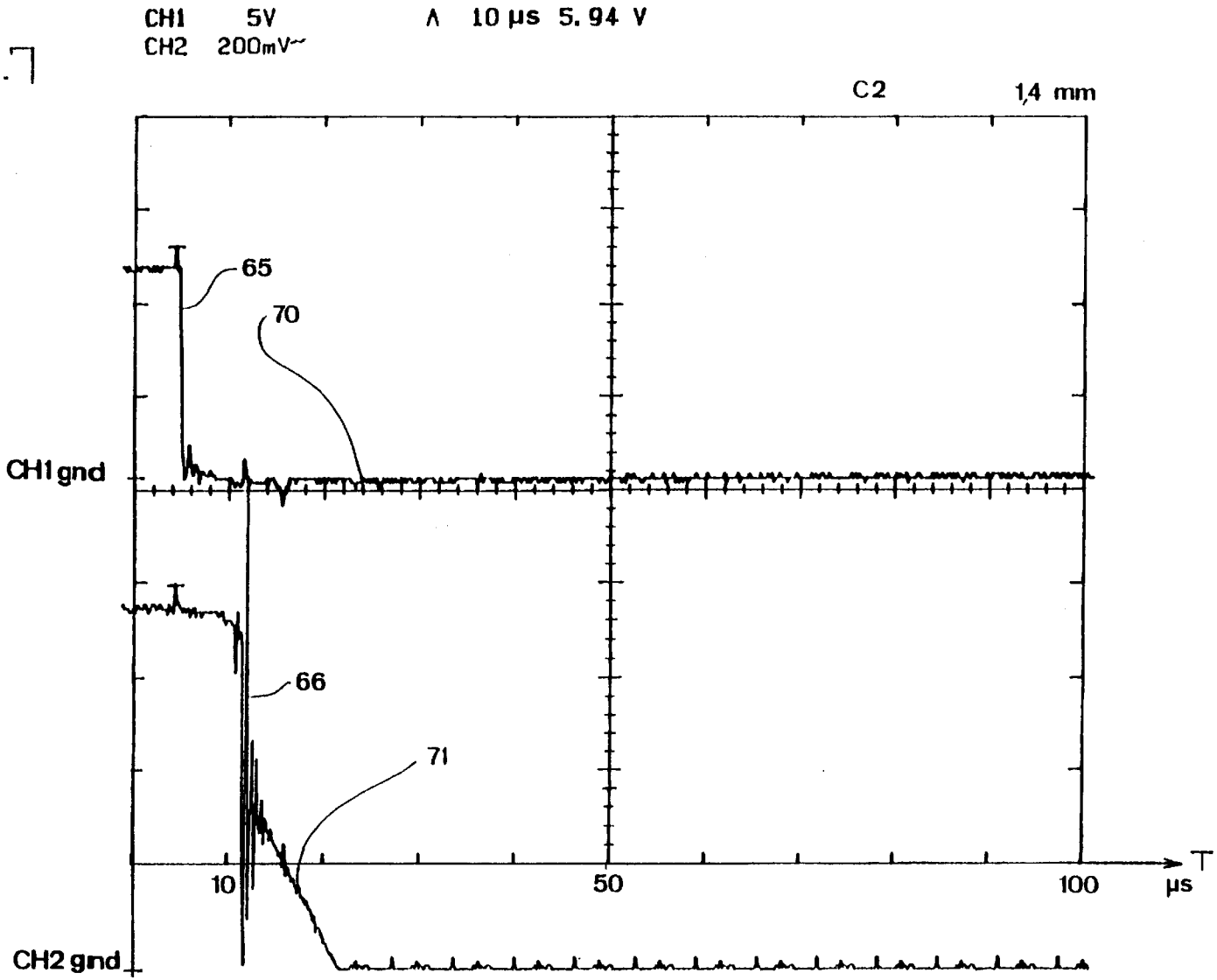
Figure 8:
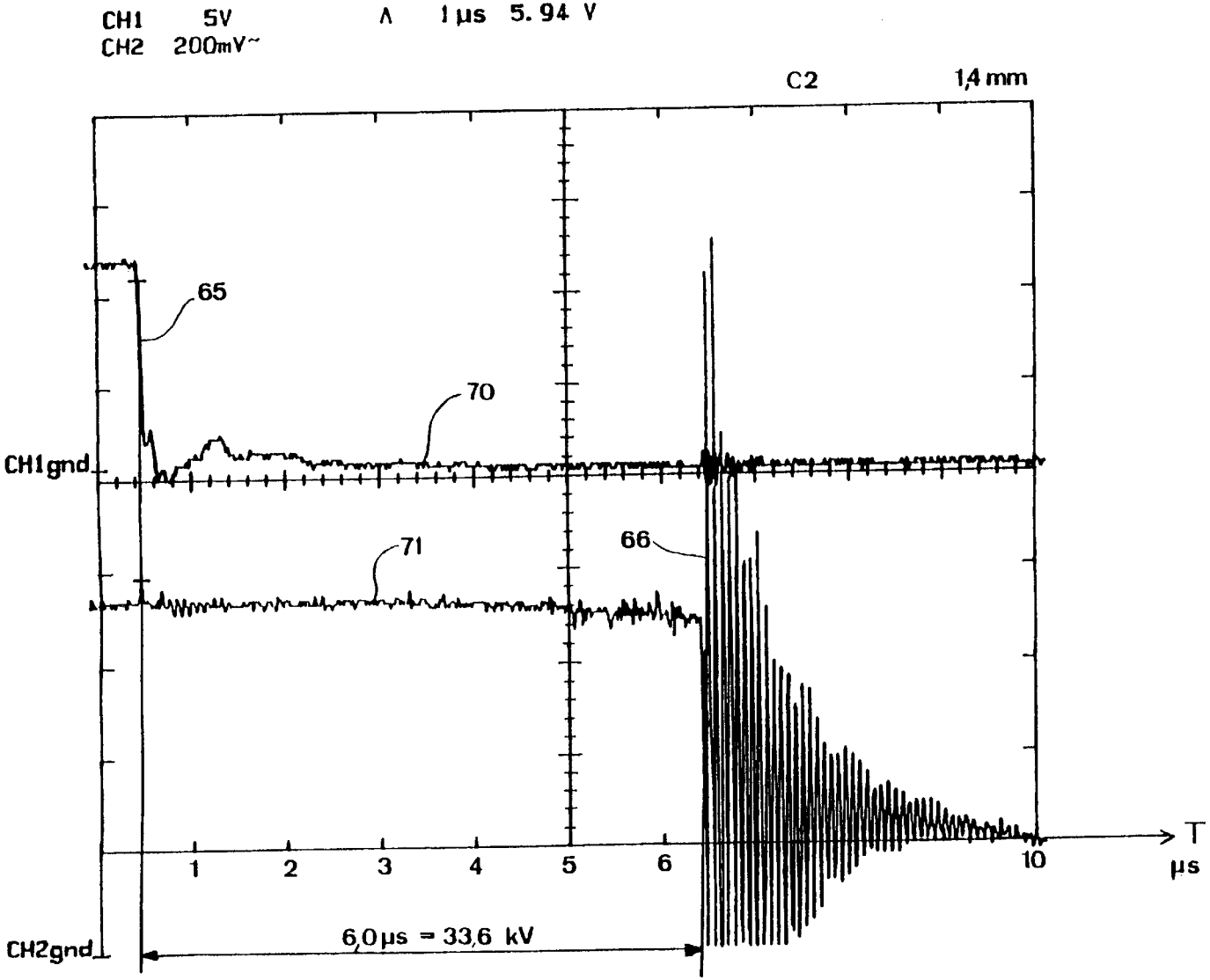
Figure 9:
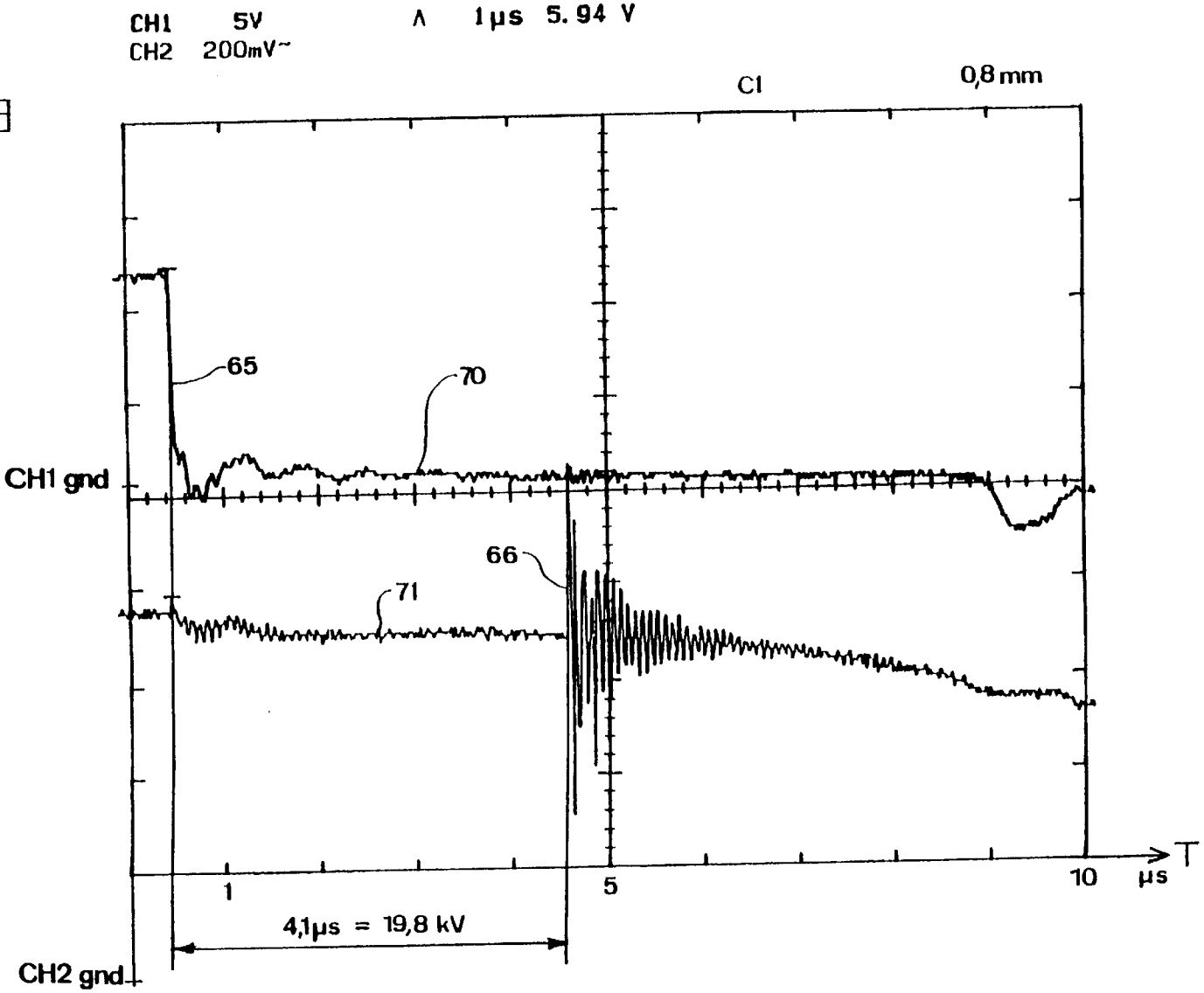

FIGS. 5–9 disclose the result of the measurements of the spark voltage. In FIG. 5 the upper curve 68 discloses the voltage as a function of the time on the secondary winding 15, 16 of the ignition coil 17, 18 and the lower curve 69 discloses the voltage as a function of the time on the charging capacitor 20. Thereby, it may be observed that the transient pulse 66 occurs simultaneously as the spark and the decrease of the voltage 68 which has been built up. Normally, a voltage of about 400V is applied to the charging capacitor 20 but in the diagrams of FIGS. 5–9 the voltage is divided with 100, i.e. the voltage in the diagram is 4V prior to the discharge. The secondary voltage disclosed in the curve 68 is at this measurement experimentally obtained by means of a high voltage probe. The rise time for the secondary voltage is constructively determined by the winding data of the ignition coil 17, 18. As is disclosed in FIG. 5, the time function of the secondary voltage has a linear characteristic at least after an initial period of about 2,8 $\mu$s, i.e. over 10 kV. FIGS. 6–9 disclose in different time scales the upper curve 70 illustrating the triggering pulse on the wire 44, 45 and the lower curve 71 illustrating the voltage on the charging capacitor 20. FIGS. 6–8 disclose the measurement result in connection with a spark plug having an electrode gap of 1,4 mm. It may be seen that the time period from the triggering to the spark is about 6,0 $\mu$s, which corresponds to a spark voltage of 33,6 kV. In FIG. 9 the corresponding electrode gap is 0,8 mm. The time period is in this case about 4,1 $\mu$s, which gives a spark voltage of 19,8 kV.

Figure 10:
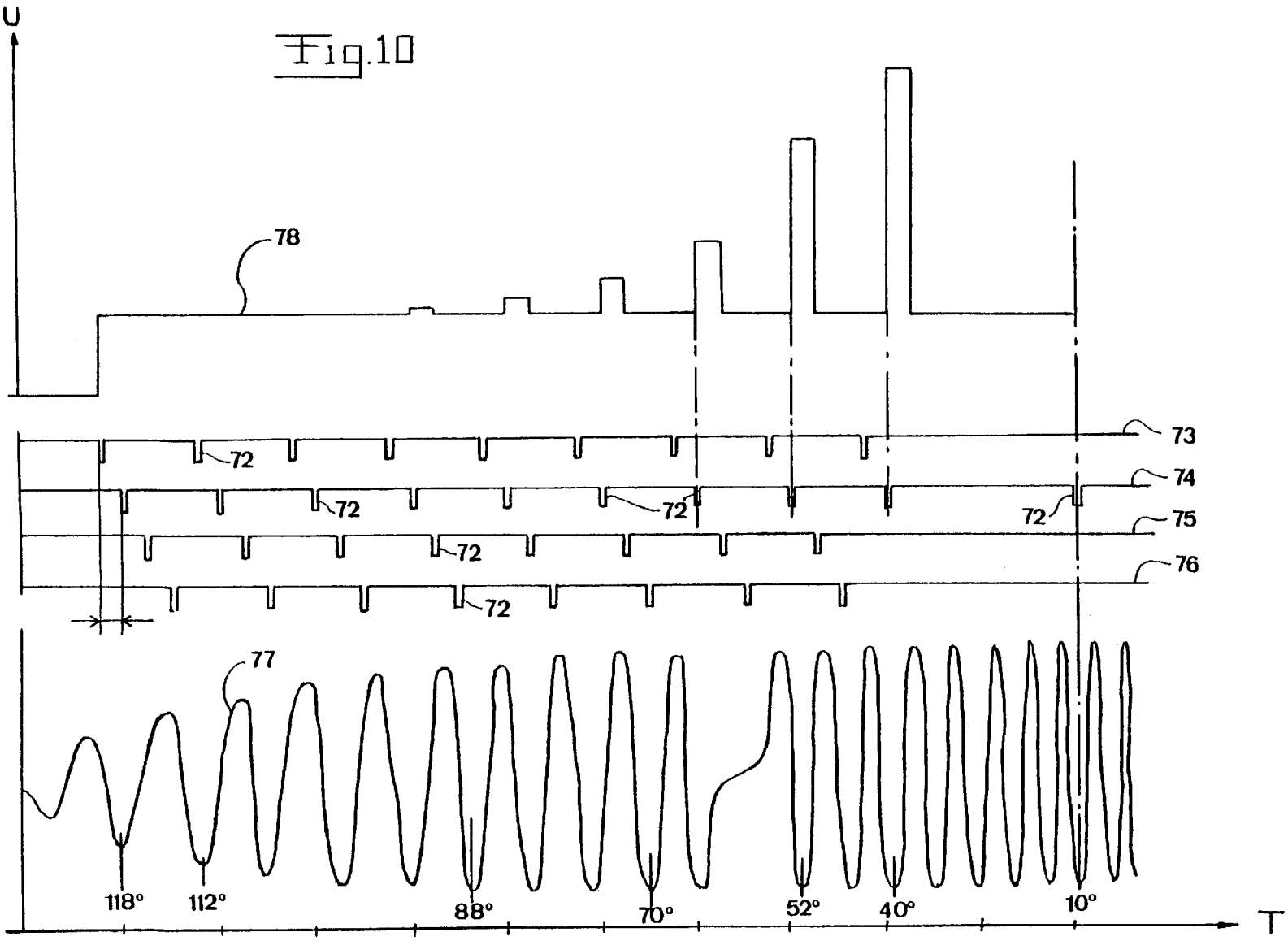
FIG. 10 shows a diagram illustrating the spark voltage, triggering pulses, and the angle position of the engine as a function of the time.

With reference to FIG. 10 the function of the present invention will now be explained more closely. When starting the engine 1 high voltage pulses 72 are supplied sequentially to all spark plugs 11–14, i.e. the high voltage pulses 72 are supplied in turn to each spark plug 11–14, which are represented by the lines 73–76 in FIG. 10. This means that every fourth such high voltage pulse 72 is supplied to the same spark plug. The high voltage pulses 72 are supplied at a very high frequency of for instance 100–500 Hz, preferably 200–400 Hz. In FIG. 10 the time interval between each pulse is 5 ms, i.e. a frequency of 200 Hz. As may be seen in the figure, the supply of pulses starts after about 15 ms, which corresponds to a crankshaft rotation of about 9°. The rotation of the crankshaft is sensed by the crankshaft sensor 6 and illustrated by the curve 77, in which the distance between every lower node represents a rotation of 60. Simultaneously to the supply of high voltage pulses. 72, the spark voltage in the electrode gap of the spark plugs 11–14 is measured according to the method described above. The level of the spark voltage is schematically disclosed by the curve 78. As shown, the spark voltage is about 4 kV when the compression is zero. Furthermore, as seen From the curves 78 and 74 the spark voltage increases for each high voltage pulse 72 supplied to the cylinder C2. Thus, it is clear that the cylinder C2 is the one which first is in the compression stroke. Consequently, the control unit 3 knows the ignition succession and may control the fuel injection in accordance therewith. As shown in FIG. 10, fuel may be injected and the ignition occur in cylinder C2 10° before the upper dead center. The crankshaft then has rotated about 112°.

Although the embodiments disclosed refer to a capacitive ignition system, the invention may also be applied to inductive ignition systems. Also in such a system it is possible to detect a transient pulse at the low voltage side of the ignition system when the spark occurs in the electrode gap of the spark plug. Furthermore, the invention may be applied not only to four-stroke engines but also to two-stroke engines.

Furthermore, it should be noted that the spark devices may be realized by other means than spark plugs, e.g. a spark device in which one of the electrodes forming the electrode gap is provided on top of the piston.

It is claimed:

1. A method of identifying the combustion chamber of a combustion engine that is in the compression stroke, the combustion engine having at least two combustion chambers and an ignition system having a spark device forming an electrode gap for each combustion chamber, which method comprises the steps of:

supplying voltage pulses sequentially to each spark device during a first engine revolution;

measuring a spark voltage of the electrode gap of each spark device; and determining from the measured spark voltages the combustion chamber that first will be in a compression stroke.

2. A method according to claim 1, wherein the combustion chamber that first will be in the compression stroke is determined by determining the spark voltage which has an increasing voltage.

3. A method of starting a combustion engine having at least two combustion chambers which are in their compression strokes in a determined sequence, and an ignition system having a spark device forming an electrode gap for each combustion chamber, which method comprises the steps of:

(a) supplying voltage pulses sequentially to each spark device during a first engine revolution;

(b) measuring a spark voltage of the electrodes gap of each spark device;

(c) determining from the measured spark voltages the combustion chamber that first will be in the compression stroke; and (d) based on said predetermined sequence and the determination in step (c) of the combustion chamber that first is in the compression stroke, injecting fuel in the combustion chamber that next will be in the compression stroke.

4. A method according to claims 1, 2 or 3, wherein the voltage pulses are supplied at a frequency of 100–500 Hz.

5. A method according to claim 4, wherein the frequency is 200–400 Hz.

6. A method according to claims 1, 2 or 3, wherein the ignition system comprises a charging member adapted to accumulate electrical energy necessary for generating a spark in each electrode gap, the charging member discharging to generate a spark, the spark voltage for each electrode gap is determined by measuring the time period from the initiating of the discharge of the charging member to the occurrence of a transient pulse indicating the spark, and the time period measured is utilized for calculating a level of the spark voltage.

7. A method according to claim 6, wherein the ignition system comprises a high voltage side and a low voltage side, and said transient pulse is sensed in the low voltage side.

8. A method according to claim 7, wherein the charging member comprises a charging capacitor provided in the low voltage side of the ignition system and said pulse is sensed at the charging capacitor.

9. A method according to claim 6 wherein the discharge of the charging member is initiated by means of a control pulse, the control pulse is detected, and the time measurement is started when the control pulse has been detected.

10. A starting device for a combustion engine having at least two combustion chambers, which device comprises:

an ignition system having at least one spark device forming an electrode gap for each combustion chamber, a charging member for accumulating electrical energy necessary for generating a spark in the electrode gap, and an electronic control unit connected to the charging member and adapted to supply high voltage pulses sequentially to each spark device during a first engine revolution;

a measuring unit for measuring a spark voltage in the electrode gap of each spark device; and the electronic control unit determining the combustion chamber that first will be in the compression stroke from said measured spark voltages.

11. A device according to claim 10, wherein the control unit determines the combustion chamber that first will be in the compression stroke by determining the spark voltage which has an increasing value for each new high voltage pulse.

12. A device according to claim 10, wherein the measuring unit comprises a time measuring member which is adapted to measure the time period from initiation of a discharge of the charging member to the occurrence of a transient pulse which indicates a spark in the electrode gap, and a calculating member which is adapted to calculate the size of the spark voltage based on the time period measured.

13. A device according to claim 10, 11 or 12, wherein the charging member comprises a coil device, a primary winding for each spark device which is connected to a current source via a primary circuit, and a secondary winding for each spark device which is connected to the spark device, said transient pulse being detected in the primary circuit.

14. A device according to claim 12, wherein the charging member comprises a charging capacitor and the time measuring member is connected to the charging capacitor in such a manner that the time measuring member may sense the voltage across the charging capacitor as it is discharged and detect said transient pulse.

15. A device according to claim 14, wherein the charging capacitor is provided in the primary circuit.

16. A device according to claim 15, wherein the electronic control unit is adapted to initiate discharge of the charging member by means of a control pulse and the measuring unit is connected to the control unit and adapted to sense the control pulse.

17. A device according to claim 16, wherein the measuring unit is connected to the electronic control unit and adapted to transmit the value of the spark voltage in each combustion chamber.

* * * * *